US006436279B1

(12) United States Patent
Colyar

(10) Patent No.: US 6,436,279 B1
(45) Date of Patent: Aug. 20, 2002

(54) SIMPLIFIED EBULLATED-BED PROCESS WITH ENHANCED REACTOR KINETICS

(75) Inventor: James J. Colyar, Newtown, PA (US)

(73) Assignee: Axens North America, Inc., Princeton, NJ (US)

( * ) Notice: Subject to any disclaimer, the term of this patent is extended or adjusted under 35 U.S.C. 154(b) by 0 days.

(21) Appl. No.: 09/708,187

(22) Filed: Nov. 8, 2000

(51) Int. Cl.[7] ..... C10G 47/00; C10G 45/00; C10G 17/00

(52) U.S. Cl. ..... 208/108; 208/107; 208/142; 208/143; 208/144; 208/145; 208/153; 208/157; 208/209; 208/251 H; 208/254 H

(58) Field of Search ..... 208/107, 108, 208/142, 143, 145, 144, 157, 153, 209, 251 H, 254 H

(56) References Cited

U.S. PATENT DOCUMENTS

| | | | | |
|---|---|---|---|---|
| RE25,770 | E | 4/1965 | Johsnson | 208/408 |
| 3,183,180 | A | 5/1965 | Schuman et al. | 208/143 |
| 4,217,206 | A | 8/1980 | Nongbri | 208/251 H |
| 4,427,535 | A | 1/1984 | Nongbri et al. | 208/112 |
| 4,576,710 | A | 3/1986 | Nongbri et al. | 208/210 |
| 4,591,426 | A | 5/1986 | Krasuk et al. | 208/96 |
| 4,684,456 | A | 8/1987 | Van Driesen et al. | 208/143 |
| 4,853,111 | A | 8/1989 | MacArthur et al. | 208/421 |
| 4,902,407 | A | 2/1990 | Chan et al. | 208/152 |

*Primary Examiner*—Thuan D. Dang

(57) ABSTRACT

This invention teaches an improved ebullated-bed reactor hydrotreating/hydrocracking process for treating heavy vacuum gas oil (HVGO) and deasphalted oil (DAO) feeds. The reactor is designed to operate at minimum catalyst bed expansion so as to maximize reactor kinetics and approach plug flow reactor process performance. Further, the invention allows for the production of a uniform product quality and production output that does not substantially vary with time.

11 Claims, 1 Drawing Sheet

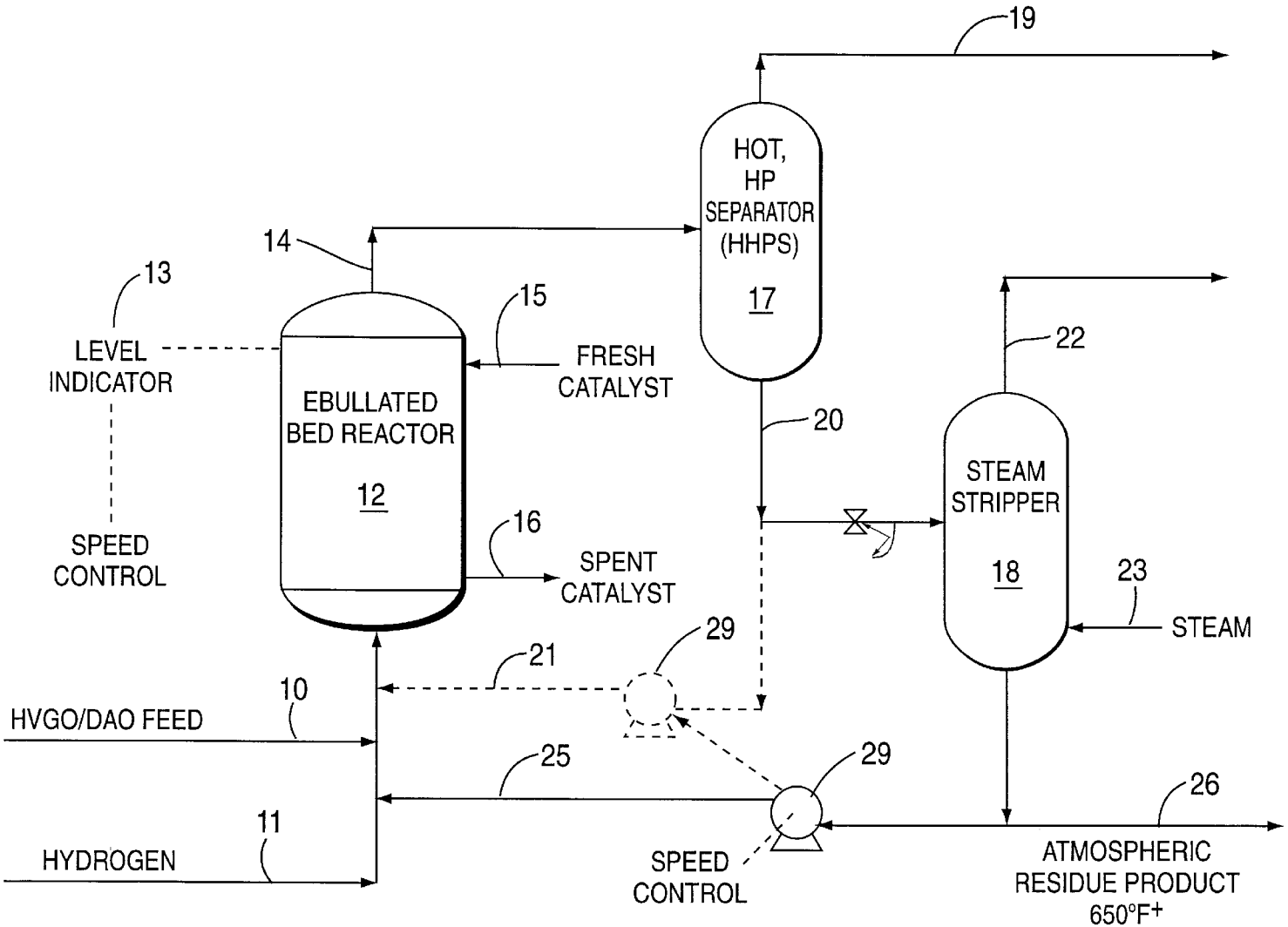
19
HOT, HP SEPARATOR (HHPS)
17
20
22
STEAM STRIPPER
18
23
STEAM
26
ATMOSPHERIC RESIDUE PRODUCT 650°F+
29
SPEED CONTROL
29
FRESH CATALYST
15
SPENT CATALYST
16
21
25
EBULLATED BED REACTOR
12
14
13
LEVEL INDICATOR
SPEED CONTROL
10
HVGO/DAO FEED
11
HYDROGEN

SIMPLIFIED EBULLATED-BED PROCESS WITH ENHANCED REACTOR KINETICS

BACKGROUND OF THE INVENTION

Hydrocarbon compounds are useful for a number of purposes. In particular, hydrocarbon compounds are useful, inter alia, as fuels, solvents, degreasers, cleaning agents, and polymer precursors. The most important source of hydrocarbon compounds is petroleum crude oil. Refining of crude oil into separate hydrocarbon compound fractions is a well-known processing technique.

Generally speaking, a refinery receives the incoming crude oil and produces a variety of different hydrocarbon products in the following manner. The crude product is initially introduced to a crude tower, where it is separated into a variety of different components including naphtha, diesel, and atmospheric bottoms (those that boil above 650° F.).

The atmospheric bottoms from the crude tower is thereafter sent for further processing to a vacuum still, where it is further separated into a heavy vacuum residue stream (e.g. boiling above 1000° F.) and vacuum gas oil (VGO) stream (boiling between 650° F. and 1000° F.). At this point the heavy vacuum residue product can be further treated to remove unwanted impurities or converted into useful hydrocarbon products.

Likewise, the VGO stream is further processed in order to yield a usable hydrocarbon product. This further processing may comprise some conversion of the VGO feedstock to diesel (boiling between 400° F. and 650° F.) as well as some cleaning hydrotreatment prior to its final processing in a Fluid Catalytic Cracker ("FCC") Unit, where it is converted into gasoline and diesel fuels.

It is at this point in the overall refinery, the hydrotreatment/hydrocracking of the VGO stream, which is the subject of the invention. As mentioned above, hydroprocessing or hydrotreatment to remove undesirable components from hydrocarbon feed streams is a well-known method of catalytically treating such heavy hydrocarbons to increase their commercial value.

More particularly, the aim of such treatment of these hydrocarbon feedstocks, particularly petroleum vacuum gas oil, may include hydrodesulfurization (HDS), carbon residue reduction (CRR), nitrogen removal (HDN), and specific gravity reduction. Additionally, such hydrocarbon streams may be hydrocracked to convert the feedstream into other lighter valuable products.

"Heavy" hydrocarbon liquid streams, and particularly heavy vacuum gas oils and deasphalted oils (DAO), generally contain product contaminants, such as sulfur, and/or nitrogen, metals and organometallic compounds which tend to deactivate catalyst particles during contact by the feedstream and hydrogen under hydroprocessing conditions. Such hydroprocessing conditions are normally in the temperature range of between 212° F. to 1200° F. (100° to 650° C.) and at pressures of from 20 to 300 atmospheres.

Generally such hydroprocessing is conducted in the presence of a catalyst containing group VI or VIII metals such as platinum, molybdenum, tungsten, nickel, cobalt, etc., in combination with various other porous particles of alumina, silica, magnesia and so forth having a high surface to volume ratio. More specifically, catalyst utilized for hydrodemetallation, hydrodesulfurirzation, hydrodenitrification, hydrocracking etc., of heavy vacuum gas oils and the like are generally made up of a carrier or base material; such as alumina, silica, silica-alumina, or possibly, crystalline aluminosilicate, with one more promoter(s) or catalytically active metal(s) (or compound(s) plus trace materials. Typical catalytically active metals utilized are cobalt, molybdenum, nickel and tungsten; however, other metals or compounds could be selected dependent on the application.

Additionally, in a modern petroleum refinery, the downtime for replacement or renewal of catalyst must be as short as possible. Further, the economics of the process will generally depend upon the versatility of the system to handle feed streams of varying amounts of contaminants such as sulfur, nitrogen, metals and/or organometallic compounds, such as those found in a vacuum gas oils and DAO's.

Hydrogenating processes treat the charge in the presence of hydrogen and suitable catalysts. The commercial hydroconversion technologies presently on the market use fixed-bed or ebullated-bed reactors with catalysts generally consisting of one or more transition metals (Mo, W, Ni, Co, etc.) supported on alumina (or equivalent material).

The decision to utilize a fixed-bed or ebullated-bed reactor design is based on a number of criteria including type of feedstock, desired conversion percentage, flexibility, run length, product quality, etc. From a general standpoint, the ebullated-bed reactor was invented to overcome the plugging problems with fixed-bed reactors as the feedstock becomes heavier and the conversion (of vacuum residue) increases. In the ebullated-bed reactor, the catalyst is fluid, meaning that it will not plug-up as is possible in a fixed-bed. The fluid nature of the catalyst in an ebullated-bed reactor also allows for on-line catalyst replacement of a small portion of the bed. This results in a high net bed activity, which does not vary with time.

More specifically, fixed-bed technologies have considerable problems in treating particularly heavy charges containing high percentages of heteroatoms, metals and asphaltenes, as these contaminants cause the rapid deactivation of the catalyst and subsequent plugging of the reactor. One could utilize numerous fixed-bed reactors connected in series to achieve a relatively high conversion of such heavy vacuum gas oil or DAO feedstocks, but such designs would be costly and, for certain feedstocks, commercially impractical.

Therefore, as mentioned above, to treat these charges, ebullated-bed technologies have been developed and sold, which have numerous advantages in performance and efficiency, particularly with heavy crudes. This process is generally described in U.S. Pat. No. Re 25,770 to Johanson, incorporated herein by reference.

The ebullated-bed process comprises the passing of concurrently flowing streams of liquids or slurries of liquids and solids and gas through a vertically cylindrical vessel containing catalyst. The catalyst is placed in motion in the liquid and has a gross volume dispersed through the liquid medium greater than the volume of the mass when stationary. This technology is utilized in the upgrading of heavy liquid hydrocarbons or converting coal to synthetic oils.

A mixture of hydrocarbon liquid and hydrogen is passed upwardly through a bed of catalyst particles at a rate such that the particles are forced into motion as the liquid and gas pass upwardly through the bed. The catalyst bed level is controlled by a recycle liquid flow so that at steady state, the bulk of the catalyst does not rise above a definable level in the reactor. Vapors, along with the liquid which is being hydrogenated, pass through the upper level of catalyst particles into a substantially catalyst-free zone and are removed at the upper portion of the reactor.

In an ebullated-bed process, the substantial amounts of hydrogen gas and light hydrocarbon vapors present rise through the reaction zone into the catalyst-free zone. Liquid is both recycled to the bottom of the reactor and removed from the reactor as net product from this catalyst-free zone. Vapor is separated from the liquid recycle stream before being passed through the recycle conduit to the recycle pump suction. The recycle pump (ebullating pump) maintains the expansion (ebullation) of the catalyst at a constant and stable level. Gases or vapors present in the recycled liquid materially decrease the capacity of the recycle pump as well as reduce the liquid residence time in the reactor and limit hydrogen partial pressure.

Reactors employed in a catalytic hydrogenation process with an ebullated-bed of catalyst particles are designed with a central vertical recycle conduit which serves as the downcomer for recycling liquid from the catalyst-free zone above the ebullated catalyst bed to the suction of a recycle pump to recirculate the liquid through the catalytic reaction zone. Alternatively, the ebullating liquid can be obtained from a vapor separator located just downstream of the reactor or obtained from an atmospheric stripper bottoms. The recycling of liquid serves to ebullate the catalyst bed, maintain temperature uniformity through the reactor and stabilize the catalyst bed.

U.S. Pat. No. 4,684,456 to R. P. Van Driesen et. al. teaches the control of catalyst bed expansion in an expanded-bed reactor and is incorporated herein by reference. In the process, the expansion of the bed is controlled by changing the reactor recycle pump speed. The bed is provided with a number of bed level detectors and an additional detector for determining abnormally high bed (interface) level. The interface level is detected by means of a density detector comprising a radiation source at an interior point within the reactor and a detection source in the reactor wall. Raising or lowering the bed level changes the density between the radiation source and the radiation detector.

Although the two processes differ dramatically, both fixed-bed and ebullated-bed reactors can be utilized to process and convert vacuum gas oil feeds, which have a typical boiling range of between 650° F. to 1000° F. Fixed-bed reactors have heretofore been mainly used when hydrotreating/hydrocracking a VGO feedstream but have numerous disadvantages including the inability to produce a constant quality (i.e. sulfur content) and quantity feedstream to a FCC Unit.

Although ebullated-bed reactor based processes are generally used for conversion of heavier vacuum residue feedstocks, they are also used to clean or treat a lower boiling point vacuum gas oil feedstock. Moreover, as mentioned above, such processes have numerous advantages over the fixed-bed design that are well known in the art including uniformity of product, reduced processing downtime, lower investment, the ability to provide a constant feedstream to a FCC Unit, etc.

Known ebullated-bed reactor designs for processing heavy vacuum gas oil and deasphalted oil feeds have length-to-diameter ratios (L/D) of approximately 6. For a given volume reactor, the greater the length-to-diameter ratio, the more catalyst that can be put into the reactor. Although there are numerous types of ebullated-bed reactor designs, it would be desirable to have a more efficient and effective ebullated-bed reactor process with improved reactor kinetics for the processing of heavy vacuum gas oil and DAO feeds. This would provide for either a cleaner feedstock to a FCC Unit or a smaller reactor size requirement (i.e. lower investment).

This invention is an improved process having numerous advantages over fixed-bed reactor systems and current ebullated-bed designs for processing vacuum gas oil and DAO feeds. This novel process employs a novel ebullating-bed reactor process having a high length-to-diameter ratio wherein the expansion of the catalyst bed above the settled-bed level is controlled at approximately 20% compared to the 40–50% typically used for ebullated-beds in HVGO and vacuum residue service.

The minimal catalyst bed expansion of 20% is set at the point where on-line catalyst withdrawal is feasible. The resulting recycle (ebullating rate) requirement is substantially reduced and is between 0.67 to 1.5 times the fresh feed rate. The dramatically reduced recycle requirement results in enhanced reactor kinetics of the hydrotreating and hydrocracking of heavy vacuum gas oil and DAO feeds. The enhanced kinetics are a direct result of a closer approach to more desirable plug-flow kinetics. Moreover, it allows the operator of the refinery to maintain a consistent volume and quality of product output that does not vary with time.

SUMMARY OF THE INVENTION

The object of this invention is to provide a novel ebullated-bed reactor design for treating heavy vacuum gas oil and deasphalted oil feeds.

It is another object of this invention to provide an ebullated-bed reactor that operates at minimum catalyst bed expansion with a minimal recycle requirement of between 0.67 and 1.5 times the fresh feed rate so as to maximize reaction kinetics and approach plug flow reactor process performance.

It is still a further object of this invention to provide an improved ebullated-bed reactor process for processing vacuum gas oil feedstocks that provides a uniform product quality and production rate not varying with time, and allows for the continuous processing of such feedstreams at various rates as required by the refinery.

It is yet a further object of the invention to provide an ebullated-bed reactor with a greater length-to-diameter ratio enabling high catalyst loading per total reactor volume and enhanced conversion and HDS performance.

Novel features of this invention are the high length-to-diameter ratio of the reactor which results in a more catalytic system and the degree of expansion of the catalyst bed which is minimized such that catalyst withdrawal is feasible while maintaining a stable operation but results in enhanced kinetics. Moreover, the recycle (ebullating) liquid requirement is in the range of 0.67 to 1.5 times the fresh oil feed rate relative to standard ebullating recycles rates, which are in excess of 2–3 times the fresh oil feed rate.

Due to the relatively low recycle ratio, the kinetics in the ebullated-bed are closer to plug-flow (i.e. further from CSTR kinetics where CSTR stands for Continuously Stirred Tank Reactor) and therefore result in enhanced conversion and hydrotreatment (e.g. HDS), particularly for VGO feed at high (greater than 95%) HDS.

Either a hot high-pressure separator liquid or stripper bottoms can be used as the recycle ebullating liquid. If stripper bottoms are utilized, there will be enhanced VGO conversion due to the concentrating effect of the recycle material since it contains a high concentration of 650° F.$^+$ material. One negative aspect of utilizing stripper bottoms as ebullating liquid is that they must be pumped from near atmospheric pressure to the relatively high pressure of the reactor.

The process of the invention describes the catalytic ebullated-bed hydrotreating/hydrocracking of heavy gas oil or DAO feedstocks comprising:

a) feeding a heavy vacuum gas oil or DAO feedstock, 80% of said feedstock boiling in the range of 650° F. to 1000° F., together with hydrogen gas to an ebullated-bed reactor, said ebullated-bed reactor having a length-to-diameter ratio greater than six and a level indicator to indicate the level of expansion of the catalyst bed contained therein;

b) separating the effluent from said ebullated-bed reactor into a gas phase and a liquid phase; and c) recycling said liquid phase to said ebullated-bed reactor at a rate of between 0.67 and 1.5 times the rate of said heavy vacuum gas oil or DAO feedstock;

wherein steps a–c are performed so as to control the catalyst bed expansion rate within said ebullated-bed reactor of between 15–25% as measured by said level indicator.

More specifically, the invention describes an improved process for processing vacuum gas oil feedstocks boiling between 650° F. and 1000° F. using an optimized ebullated-bed reactor wherein the improvement comprises: the utilization of an ebullated-bed reactor having a length-to-diameter ratio greater than six and wherein the catalyst bed expansion percentage within said ebullated-bed is controlled to between 15% and 25%.

BRIEF DESCRIPTION OF THE DRAWINGS

This invention will be described further with reference to the following drawing in which:

FIG. 1 is a schematic flowsheet of an integrated process with the novel features of the invention described therein.

DETAILED DESCRIPTION OF THE DRAWINGS

FIG. 1 shows a detailed schematic flowsheet of the invention. As shown by FIG. 1, a heavy vacuum gas oil (HVGO) or deasphalted oil (DAO) feed stream is provided at 10, and hydrogen is added at 11. Thereafter, the combined stream is fed into an ebullated-bed catalytic hydrogenation reactor 12, along with recycle ebullated liquid supplied at 21 or 25, as described below.

The reactor 12 has a level indicator 13 to show the level of the catalyst therein. The level indicator 13 controls the speed of pump 29 which modifies the flow of recycle liquid 21 or 25 to the reactor 12 thereby controlling the catalyst bed expansion. Fresh catalyst is added to the reactor at line 15 and is withdrawn from the reactor at line 16 and is typically done on a daily basis.

The ebullated-bed reactor effluent 14 is passed through the external hot, high pressure separator ("HHPS") 17 wherein it is separated into gas and liquid phases. The gas phase, comprised largely of hydrogen and gaseous and vaporized hydrocarbons is drawn off by line 19 and thereafter conventionally treated to recover hydrogen, hydrocarbon gases, etc. Although not shown here, it is typical to utilize the separated purified hydrogen as part of the hydrogen feed 11 to the system.

The net liquid phase drawn from the HHPS 17 through line 20 is sent to a steam stripper 18. A portion of the liquid phase effluent is pumped to reactor pressure for recycling to reactor 12 after being combined with fresh feedstock 10 and hydrogen 11. As mentioned above, by minimizing the bed expansion and utilizing a higher reactor design length-to-diameter ratio, a reduction in the amount of recycle to fresh feedstock is achieved, improving the catalyst loading (weight of catalyst per volume of reactor), reactor kinetics, and overall process efficiency.

Steam is supplied to an atmospheric steam stripper through line 23 and overhead product from steam stripper 18 is drawn of by line 22. Stripper bottoms products (nominal 650° F.$^+$ boiling) are drawn off at line 26 or recycled back to the ebullating bed reactor 12 through line 25.

The recycle ebullating liquid may be either high-pressure separator liquid from the HHPS 17 or stripper bottoms from the atmospheric steam stripper 18. Stripper bottoms may enhance the conversion rate achieved due to the concentrating effect of the recycle material since it contains a high concentration of 650° F.$^+$ material. A higher energy cost for pumping the stripper bottoms to reactor pressure will, however, be evident.

The rate of recycle ebullating liquid supplied at 21 or 25 is controlled to attain a specified level of expanded catalyst in reactor 12. Since the expansion is relatively small (15–25%) compared with those in the prior art, additional catalyst can be added to reactor 12 in order to effectively fill the reactor.

A key feature of this invention is that the catalyst bed expansion is set at approximately 20% and is set to adequately fluidize the catalyst bed and allow for the withdrawal of spent catalyst through line 16. The lower expansion allows more fresh catalyst to be placed in the ebullated-bed reactors for a given total reactor volume. The net liquid effluent from the HHPS 17 is sent to the steam stripper 18 where it is processed and drawn off as stripper bottoms product (650° F.$^+$ boiling point) through line 26 and thereafter is typically sent to a FCC Unit (not pictured).

Likewise, if the recycle is supplied via the steam stripper 18 the net effluent from the steam stripper 18 is processed and drawn off as stripper bottoms product (650° F.$^+$ boiling point) through line 26 and sent to a FCC Unit (not pictured).

By setting the bed expansion to approximately 20% and utilizing high reactor length-to-diameter ratio, the rate of ebullating recycle is significantly reduced, resulting in less back-mixing and dramatically improved reactor kinetics and higher HDS levels.

The reactor 12 is maintained at broad reaction conditions as shown in Table 1 below:

| Condition | Broad | Preferred |
|---|---|---|
| Feedstock Residue Content, vol. % 650° F.$^+$ | 50–100 | 80–100 |
| Reactor LHSV (liquid hourly space velocity), $hr^{-1}$ | 0.3–3.0 | 0.5–2.0 |
| Reactor Temperature ° F. | 700–850 | 740–840 |
| Reactor total pressure, psig | 500–3,500 | 800–2,000 |
| Reactor outlet hydrogen partial pressure, psi | 400–2,000 | 500–1,500 |
| Reactor superficial gas velocity, fps | 0.02–0.30 | 0.025–0.20 |
| Catalyst Replacement Rate, lb/bbl | 0.03–0.5 | 0.05–0.30 |
| Catalyst bed expansion, % | 10–40 | 15–25 |

Suitable hydrogenation catalysts for the reactor 12 include catalysts containing nickel, cobalt, palladium, tungsten, molybdenum and combinations thereof supported on a porous substrate such as silica, alumina, titania, or combinations thereof.

The above invention is therefore a novel ebullated-bed hydrotreating/hydrocracking process for treating heavy vacuum gas oil and DAO feeds. By operating a minimal bed expansion in combination with higher reactor length-to-diameter ratios, this novel process maximizes reactor kinetics through the maximizing of catalyst loading and use of a minimal ebullating rate to reduce back mixing and approach preferred plug-flow reactor kinetics.

This invention will be further described by the following example, which should not be construed as limiting the scope of the invention.

EXAMPLE 1

To demonstrate the process advantages of this invention, analyses of three commercial ebullated-bed reactor cases have been developed and are presented below. The basis for comparison is the catalytic single-stage ebullated reactor typical for processing heavy vacuum gas oil and DAO feedstocks. The first case incorporates the standard design for an ebullated-bed reactor process that does not utilize the novel features of this invention. The other two cases incorporate the novel aspects of this invention. These examples are based on actual and commercial data at either identical or similar reaction and operating conditions, including feedstock and catalyst characteristics. The operating conditions and feedstock analyses for the three comparative cases are listed in Table 2 and Table 3 respectively below.

TABLE 2

| Case No. | 1 | 2 | 3 |
|---|---|---|---|
| OPERATING CONDITIONS | | | |
| VGO Feedrate, BPSD | 40,000 | 40,000 | 33,000 |
| Reactor, L/D | 6 | 8 | 12 |
| LHSV, $hr^{-1}$ (based on catalyst volume) | 1.0 | 1.0 | 1.0 |
| Reactor Temperature ° F. | $T_1$ | $T_1 + 3$ | $T_1 + 11$ |
| Reactor Diameter, ft | 13.5 | 12.25 | 10 |
| Reactor Height, ft | 81 | 98 | 120 |
| Catalyst Bed Expansion, % above settled | 40 | 20 | 20 |
| Required $V_{liq}$ to attain expansion, ft/Sec | 0.13 | 0.090 | 0.09 |
| $V_{feed}$, ft/Sec | 0.030 | 0.036 | 0.054 |
| $V_{ebullating\ recycle}$, ft/Sec (by difference) | 0.090 | 0.054 | 0.036 |
| Ebullating Recycle, BPSD | 120,000 | 60,000 | 22,000 |
| 650° F.+ conversion, Wt. % | 30 | 30 | 30 |
| Ebullating Recycle to feedstock ratio, V/V | 3 | 1.5 | 0.67 |
| PROCESS PERFORMANCE | | | |
| HDS, wt. % | 93.3 | 95.7 | 97.8 |
| Approximate Sulfur Content of Product, wppm | 1,980 | 1,270 | 650 |

TABLE 3

FEEDSTOCK ANALYSES

| Characteristic | Value |
|---|---|
| Crude Source Type | Arabian Heavy Vacuum Gas Oil |
| Gravity, ° API | 19.4 |
| Sulfur, wt % | 2.96 |
| Nitrogen, wppm | 1,170 |
| Nickel + Vanadium, wppm | <5 |
| 650° F.+, Vol. % | 100 |
| Hydrogen, W % | 11.8 |

As mentioned above, for base case 1 the ebullated-bed reactor was operated using standard design conditions prior to the invention described herein. The standard reactor design had a length-to-diameter ratio of 6 and a catalyst bed expansion percentage of 40%. For the two improvement cases 2 and 3, improved results were seen using the larger length-to-diameter ratio (8 and 12, respectively) and a lower ebullating recycle rate to control the catalyst bed expansion at 20%.

In all three cases an Arabian Heavy Vacuum Gas Oil feedstock boiling between 650° F. and 1000° F. was fed into the ebullated-bed reactor. For the base case 1 in which none of the novel features of the invention were incorporated and case 2 having the new features of the invention, the feedstock was fed at a rate of 40,000 BPSD. For case 3, also having the features of the invention, the feed rate was 33,000 BPSD. The feed rate for this last case is reduced from 40,000 BPSD in order that the calculated reactor height is less than or equal to 120 feet which is considered to be a reasonable maximum for erection concerns.

As clearly evidenced in Table 2, cases 2 and 3 (both of which incorporate the novel features of the invention), improved hydrogenation performance is shown relative to the reactor system with the standard design (case 1). Both cases have improved hydrodesulfurization (HDS) percentages (95.7 and 97.8 vs. 93.3) and dramatically lower recycle rates. The net result of the higher HDS rate is a product sulfur content in case 3 that is one-third that of the base case.

Moreover, in the standard design, the recycle required at the 40,000 BPSD feed rate was 120,000 BPSD, resulting in a recycle-to-feedstock ratio of 3. Cases 1 and 2 had dramatically lower recycle-to-feedstock ratios of 1.5 and 0.67, respectively. Such lower recycle rates decrease the expansion rate of the catalyst bed, noticeably improving the reactor kinetics (less backmixing, etc.) and resulting in improved kinetics and a more efficient overall process.

The three cases shown in Table 2 operate at the same level of 650° F.+ conversion (30%). Due to the modification in reactor dimensions in case 2, a small 3° F. higher temperature is required to maintain the level of conversion. The slightly higher temperature is required due to the higher gas velocity (smaller reactor ID) and lower liquid residence time.

In case 3, a higher reactor temperature overcomes this same effect. The increase in temperature for cases 2 and 3 is a distinct but secondary reason for the increase in hydrogenation performance. As discussed herein, the higher performance is attributed to the (1) optimized reactor dimensions (L/D) and resultant high catalyst loading; and (2) the improved kinetics (less back mixing) due to a low bed expansion and lower ebullating recycle rate (0.67 and 1.5 vs. 3).

Although this invention has been described broadly and also in terms of preferred embodiments, it will be understood that modifications and variations can be made to the reactor and process that are all within the scope of the invention as defined by the following claims.

I claim:

1. A process for catalytic ebullated-bed hydrotreating/hydrocracking of heavy vacuum gas oil or deasphalted oil (DAO) feedstocks comprising:

a) feeding a fresh heavy vacuum gas oil or DAO feedstock, 80% of said feedstock boiling in the range of 650° F. to 1000° F., together with hydrogen gas to an ebullated-bed rector, wherein said heavy vacuum gas oil or DAO feedstock is hydrotreated/hydrocracked to produce an effluent containing clean liquid petroleum products and other light hydrocarbons, said ebullated-bed reactor having a length-to-diameter ratio greater than eight and a level indicator to indicate the level of expansion of the catalyst bed contained therein;

b) separating the effluent from said ebullated-bed reactor into a gas phase and a liquid phase; and c) recycling said liquid phase to said ebullated-bed reactor at a rate of between 0.67 and 1.5 times the rate of said fresh heavy vacuum gas oil or DAO feedstock;

wherein steps a–c are performed so as to control the catalyst bed expansion rate within said ebullated bed reactor of between 15–25% as measured by said level indicator.

2. The process of claim 1 wherein said liquid phase from step b) is further processed in a steam stripper to produce stripper bottoms prior to step c) so that an ebullating recycle is obtained from the stripper bottoms.

3. The process of claim 1 wherein steps a–c are performed so as to allow a catalyst bed expansion rate of about 20% as measured by said level indicator.

4. The process of claim 1 wherein the liquid phase is recycled to the ebullating-bed reactor at a rate of less than 1.5 times the rate of the fresh heavy gas oil or DAO feedstock.

5. The process of claim 1 wherein the liquid phase is recycled to the ebullating-bed reactor at a rate of less than 1.0 times the rate of the fresh heavy gas oil or DAO feedstock.

6. The process of claim 1 wherein the catalyst in the ebullated-bed reactor is replaced at a rate of between 0.03 and 0.50 pounds of catalyst per barrel of fresh food to the reactor.

7. The process of claim 1 wherein the catalyst in the ebullated-bed reactor is replaced at a rate of between 0.05 and 0.30 pounds of catalyst per barrel of fresh feed to the reactor.

8. The process of claim 1 wherein the ebullated-bed reactor has a length-to-diameter ratio of 8 or greater.

9. The process of claim 1 wherein the ebullated-bed reactor has a length-to-diameter ratio of greater than 10.

10. The process of claim 1 wherein the ebullated-bed reactor has a length-to-diameter ratio of 12 or greater.

11. An improved process for processing vacuum gas oil feedstocks boiling between 650° F. and 1000° F. using an ebullated-bed reactor wherein the improvement comprises: the utilization of an ebullated-bed reactor having a length-to-diameter ratio greater than eight, and wherein the catalyst bed expansion precentage within said ebullated-bed is controlled to between 15% and 25%.

* * * * *